United States Patent [19]

Tamaki et al.

[11] Patent Number: 4,809,659

[45] Date of Patent: Mar. 7, 1989

[54] MOTOR-DRIVEN THROTTLE VALVE ASSEMBLY

[75] Inventors: Sigeo Tamaki; Isamu Ishizawa, both of Katsuta, Japan

[73] Assignee: Hitachi, Ltd., Tokyo, Japan

[21] Appl. No.: 56,653

[22] Filed: Jun. 2, 1987

[30] Foreign Application Priority Data

Jun. 2, 1986 [JP] Japan ..... 61-125756

[51] Int. Cl.[4] ..... F02D 9/00

[52] U.S. Cl. ..... 123/399; 123/361

[58] Field of Search ..... 123/339, 361, 399

[56] References Cited

U.S. PATENT DOCUMENTS

| | | | |
|---|---|---|---|
| 4,367,805 | 1/1983 | Totani et al. | 123/361 X |
| 4,424,781 | 1/1984 | Speer et al. | 123/342 |
| 4,455,978 | 6/1984 | Atago et al. | 123/361 X |
| 4,519,360 | 5/1985 | Murakami | 123/399 |
| 4,569,321 | 2/1986 | Bonfiglioli et al. | 123/339 X |

FOREIGN PATENT DOCUMENTS

| | | | |
|---|---|---|---|
| 0112150 | 6/1984 | European Pat. Off. | 123/399 |
| 3146652 | 6/1983 | Fed. Rep. of Germany | 123/399 |
| 0025853 | 5/1983 | Japan . | |
| 59-25053 | 2/1984 | Japan | 123/361 |

OTHER PUBLICATIONS

Motorcycle Repair Manual by Bob Greene, Petersen Publishing Co., 1972, p. 183.

*Primary Examiner*—Tony M. Argenbright
*Assistant Examiner*—Eric R. Carlberg
*Attorney, Agent, or Firm*—Antonelli, Terry & Wands

[57] ABSTRACT

This invention relates to a motor-driven throttle valve assembly which drives a motor according to the amount of depression of the accelerator pedal (9) and thereby controls the opening of the throttle valve (2). The motor-driven throttle valve assembly of this invention has a restricting plate (14), which is located between the throttle valve shaft bearing (16) on the motor side and a gear mechanism (10) transmitting the rotation of the motor to the throttle valve shaft (3), controls the rotation of the throttle valve shaft (3) toward the closed position.

3 Claims, 1 Drawing Sheet

MOTOR-DRIVEN THROTTLE VALVE ASSEMBLY

This invention relates to a throttle valve assembly used in internal combustion engines and more particularly to a motor-driven throttle valve assembly which controls the opening of the throttle valve according to the output of the motor.

A conventional apparatus of the above type is disclosed, for instance, in the Japanese Application Publication No. 25853/1983 titled "Throttle Valve Control Apparatus for Internal combustion Engine" published on May 30, 1983. In this example, the torque of the motor is amplified by gear and transmitted to the throttle valve.

The drawback of the conventional throttle valve assembly is that when the throttle valve is turned toward the closed position, the valve is thrown into the fully closed position with strong force and gets stuck with the wall of the throttle valve intake air cylinder. The conventional practice to solve this problem requires setting the gap between the throttle valve and the wall of the throttle valve intake air cylinder to approximately 7 degrees. This, however, raises another problem that exhaust gas accumulates in that gap blocking the passage of air through it.

SUMMARY OF THE INVENTION

The object of the present invention is to provide a motor-driven throttle valve assembly which prevents the throttle valve at the fully closed position from getting stuck with the internal wall surface of the throttle valve intake air cylinder and which prevents exhaust gas from accumulating in the gap between the throttle valve and the internal wall of the throttle valve intake air cylinder.

This invention is characterized by a stopper provided to the throttle valve shaft at a point between bearing supporting the throttle valve and a gear mechanism restricting the rotation of throttle valve toward the closed position.

According to the present invention, when the throttle valve is turned in the direction of the closed position, the rotation thereof is restricted slightly before reaching the fully closed position by the stopper, thereby preventing the throttle valve from getting seized with the wall surface of the throttle valve intake air cylinder. This structure also eliminates unnecessary twisting of the throttle valve shaft.

DETAILED DESCRIPTION OF THE PREFERRED EMBODIMENTS

Figure 1:
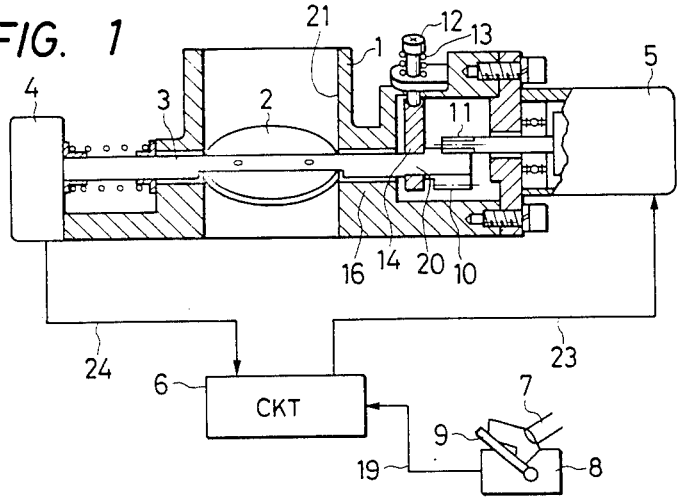
FIG. 1 is a partial cross sectional view of the throttle valve assembly of one embodiment according to the present invention, showing a stopper installed inside the throttle valve assembly to restrict the rotation of the throttle valve shaft toward the closed position.

Referring to FIG. 1, when a driver 7 depresses an accelerator pedal 9, an accelerator opening detector 8 senses the degree of pedal depression and sends a signal 19 to a control circuit 6. The control circuit 6, according to the signal 19 which is taken as the driver's intention, produces a signal 23 to the stepping motor 5 to start it. The rotation of the stepping motor 5 is transmitted to the throttle valve shaft 3 in the throttle valve assembly 1 to control the movement of the throttle valve 2.

To check the operated position of the throttle valve 2, a throttle valve opening detector 4 is provided. The throttle valve opening detector 4 produces a failsafe signal 24 to the control circuit 6. The throttle valve 2 controlling the engine revolution speed is connected to and controlled by the output shaft 11 of the stepping motor 5 through the gear 10.

In general, the output axis 11 of the stepping motor is connected to the throttle valve shaft 3 through the gear 10. Since the throttle valve does not return to the idling state owing to the rotational force based on the force of inertia of the stepping motor, the return spring 13 is equipped to overcome the rotational force. The throttle valve is held by the restricting plate 14 fixed to the throttle valve shaft 3 playing the role of stopper and the adjusting screw 12 so that the throttle valve is able to hold the idling state by the return spring 13. When the car decelerates, the motor rotates the throttle valve shaft 3 toward the closed position with strong force owing to the force of inertia of the motor. When the car decelerates and the throttle valve is turned by motor to a specified idle position, say, one degree before the fully closed position, the end 18 of the restricting member 14 abuts against the end 17 of the adjusting screw 12 attached to the housing 1 of the throttle valve assembly. Further rotating of the throttle vale due to inertia is blocked thus preventing the valve from getting stuck with the inside wall of the intake air cylinder.

An important thing to be noted is that the restricting member 14 is located near the gear mechanism 10. If the restricting member is installed on the shaft on the other bearing side opposite to the motor, when the restricting member 14 abuts against the adjusting screw 12, a torsional stress develops in the throttle valve shaft 3, which may result in a break or bending of the throttle valve shaft or seizure of the throttle valve in the inside wall of the intake air cylinder.

With this invention, however, since the restricting member 14 is provided between the bearing 16 on the motor side and the gear mechanism 10, no torsional stress is produced in the throttle valve shaft 3 when the restricting member 14 strikes the adjusting screw 12.

Figure 3:
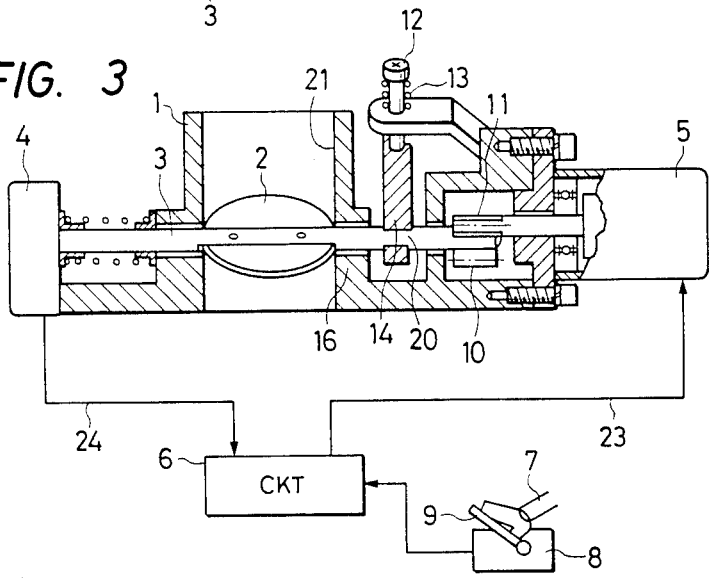
FIG. 3 is a partial cross sectional view of the throttle valve assembly of another embodiment according to the present invention, showing the stopper installed outside the throttle valve assembly.

To reduce wear of the adjusting screw, 12 and the restricting member 14, their surfaces may be hardened as by quenching. If operation of this mechanism produces no abrasive particles from wear, the stopper assembly may be installed inside the throttle valve assembly as shown in FIG. 1. If worn particles are produced from the contacting action of the restricting member and screw, the stopper assembly may be installed outside the throttle valve assembly as shown in FIG. 3 since the abrasive particles would adversely affect the operation of the gear mechanism 10. The stepping motor may be replaced by a DC motor, which has an inertia, without losing the effect of the invention.

Figure 2:
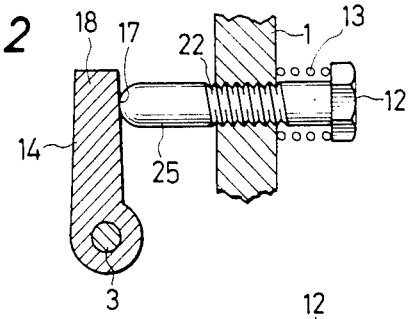
FIG. 2 is a partial enlarged view of FIG. 1, showing the stopper and an adjusting screw.

Since the shank 25 of the adjusting screw 12 shown in FIG. 2 has threads 22 by which the screw 12 when turned moves back and forth through the housing 1 of the throttle valve assembly, the restricting plate can be positioned with high accuracy.

What we claim is:

1. In a motor-driven throttle valve assembly in which a motor controls the opening of the throttle valve which rotates inside a throttle valve assembly housing according to a signal representing the amount of depression of an accelerator pedal and rotation of the motor is transmitted to a shaft of the throttle valve through a gear mechanism installed between the output shaft of the motor and the throttle valve shaft, wherein the improvement comprises a stopper disposed in the throttle valve assembly housing with the motor and mounted on a part of the throttle valve shaft bearing on the motor side and the gear mechanism, said stopper being operative to keep the gap between the throttle valve and an air horn wall of the throttle valve assembly housing within a specified value when the throttle valve is near a fully closed position.

2. A motor-driven throttle valve assembly as set forth in claim 1, wherein the stopper is secured to the throttle valve shaft so that it rotates with the shaft, and the stopper has an adjusting screw with a projecting part adapted to abut against the radially outward portion of the stopper to restrict the rotation of the throttle valve toward the closed position so that the throttle valve stops in a specified position.

3. A motor-driven throttle valve assembly as set forth in claim 2, wherein the projecting part of the adjusting screw has threads by which the screw when turned is moved forward and backward through the throttle valve assembly housing.

* * * * *